United States Patent [19]

Toogood

[11] 4,368,013

[45] Jan. 11, 1983

[54] GEAR MOTOR WITH FLUID PRESSURE GROOVE AND RECESS TO FACILITATE STARTING

[75] Inventor: Graham J. Toogood, Cheltenham, England

[73] Assignee: Dowty Hydraulic Units Limited, Cheltenham, England

[21] Appl. No.: 158,152

[22] Filed: Jun. 10, 1980

[30] Foreign Application Priority Data

Jun. 19, 1979 [GB] United Kingdom ..... 7921351

[51] Int. Cl.[3] ..... F01C 1/18; F01C 21/12; F03C 2/08

[52] U.S. Cl. ..... 418/74; 418/78; 418/132; 418/206

[58] Field of Search ..... 418/74, 78, 131–135, 418/205, 206

[56] References Cited

U.S. PATENT DOCUMENTS

| | | | |
|---|---|---|---|
| 2,310,078 | 2/1943 | Herman | 418/74 |
| 2,541,010 | 2/1951 | Ungar | 418/78 |
| 2,626,570 | 1/1953 | Armington et al. | 418/74 |
| 3,539,282 | 11/1970 | Forschner | 418/205 |
| 3,748,063 | 7/1973 | Putnam | 418/132 |
| 3,833,319 | 9/1974 | Eglington | 418/132 |
| 4,087,216 | 5/1978 | Shumate | 418/74 |

*Primary Examiner*—John J. Vrablik
*Attorney, Agent, or Firm*—Young & Thompson

[57] ABSTRACT

A rotary positive-displacement fluid-pressure motor which includes a casing, having an inlet port and an outlet port, at least two intermeshing rotors of toothed or lobed form housed for rotation in the casing, and means for conducting pressure fluid derived from the inlet port as far as a predetermined position in a face adjacent, and engaged by, a side of one of the rotors. A recess is so disposed in that face intermediate the predetermined position and the outlet port that, for facilitating starting of the motor when fluid under high pressure is directed into the inlet port, some of that fluid can gain access to the recess by way of said means and whichever intertooth or interlobe space of that rotor is so positioned as to place the means and the recess in communication.

10 Claims, 7 Drawing Figures

GEAR MOTOR WITH FLUID PRESSURE GROOVE AND RECESS TO FACILITATE STARTING

Figure 1:
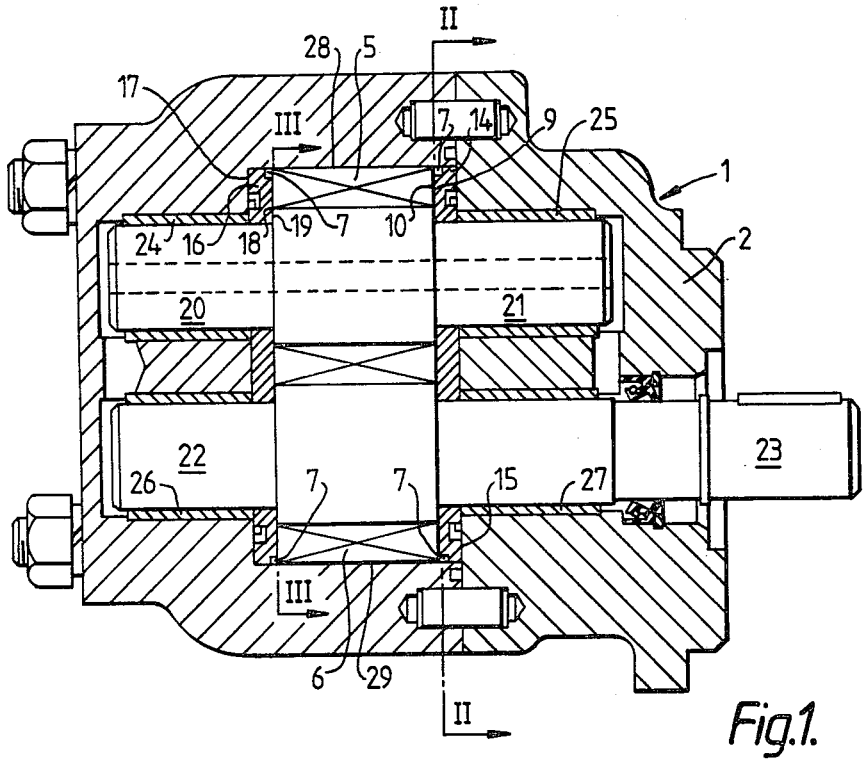

This invention relates to fluid-pressure operable gear motors, having means to facilitate starting.

Hitherto, in order to reduce frictional resistance, during starting of such motors, which otherwise occurs due to certain teeth or lobes of the intermeshing rotors thereof being urged by the pressure subsisting in the motor high pressure inlet port with substantial force against portions, opposite that port, of the respective adjacent cylindrical walls of the motor casing, means have been provided whereby fluid under high pressure is conducted to those portions to oppose that substantial force.

In certain constructions such means have comprised what are termed "pressure field control grooves" which extend part-way around the peripheral edge of end plate means adjacent the respective rotor from the motor inlet port. It has been found in practice that if the extent of each such groove in the direction away from the inlet port is such that its end remote from the inlet port is at a position where the greatest benefit for opposing the said substantial force is attained, an excessive amount of flow is taken from the inlet port, with the result that the volumetric efficiency of the motor is seriously impaired. If, on the other hand, in the interests of maintaining an acceptable volumetric efficiency the groove is shorter, then the furthest position at which fluid pressure is applied in opposition to the said substantial force is not far enough from the inlet port to achieve a really adequate reduction in frictional resistance at the tips of the teeth or lobes of the respective rotor and thus it has been found that the motor, when under extremes of applied external loading upon the output shaft thereof, often stalls when an attempt to start the motor is made.

The invention as claimed is intended to provide a remedy. It solves the problem of how to design a rotary positive-displacement fluid-pressure motor in which fluid under high pressure is conducted to such a position as adequately to oppose said substantial force thus significantly to reduce frictional resistance at the tips of the teeth or lobes and yet to avoid undesirable loss in volumetric efficiency of the motor.

According to this invention a rotary positive-displacement fluid-pressure motor includes a casing, having an inlet port and an outlet port, at least two intermeshing rotors of toothed or lobed form housed for rotation in said casing, means for conducting pressure fluid derived from said inlet port as far as a predetermined position in a face disposed adjacent, and engaged by, a side of one of said rotors, and a recess so disposed in said face intermediate said predetermined position and said outlet port that, for facilitating starting of the motor when fluid under high pressure is directed into the inlet port, some of that fluid can gain access to said recess by way of said means and whichever intertooth or interlobe space of that rotor is so positioned as to place said means and said recess in communication.

The advantage offered by the invention is that the fluid under pressure, which so gains access to said recess, at least momentarily provides a force in such a direction onto said rotor as, adequately, will oppose the substantial force applied directly onto said rotor from said inlet port, thereby reducing frictional resistance otherwise set up between the casing and those teeth or lobes of the rotor which are positioned in the vicinity of said recess, and thus avoiding stalling of the motor when an attempt to start it is made.

Figure 2:
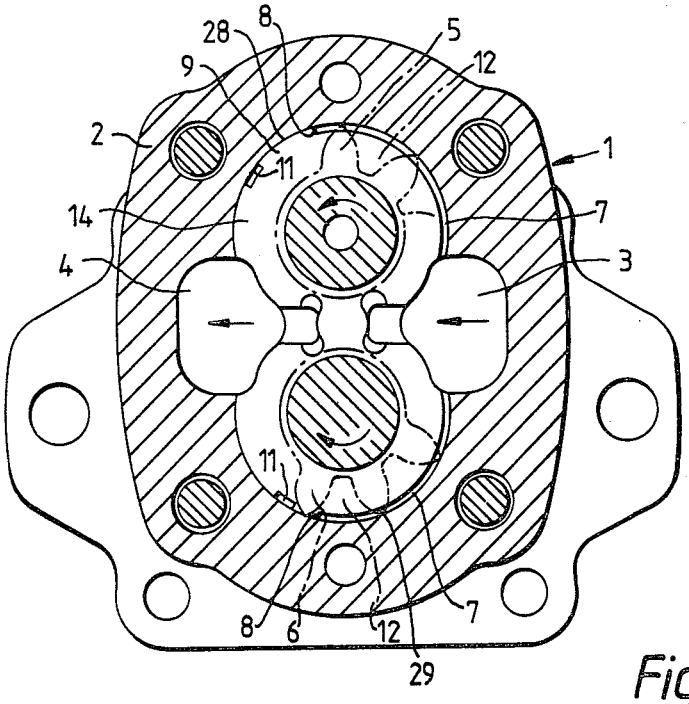
Figure 3:
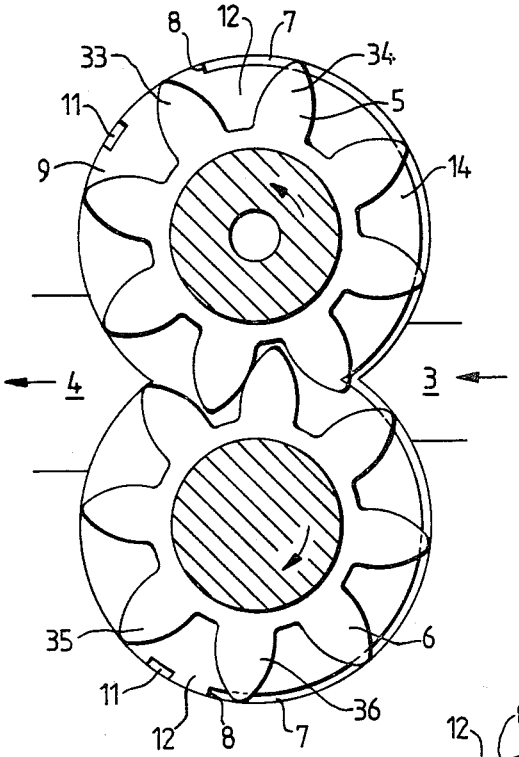
Figure 4:
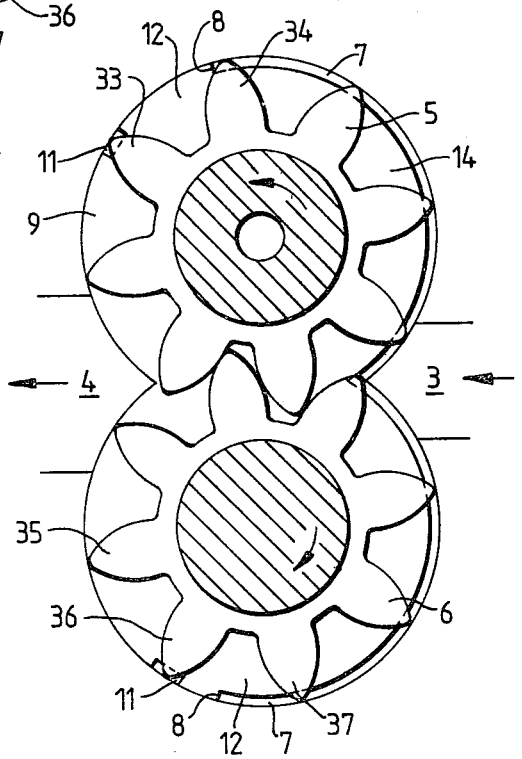
Figure 5:
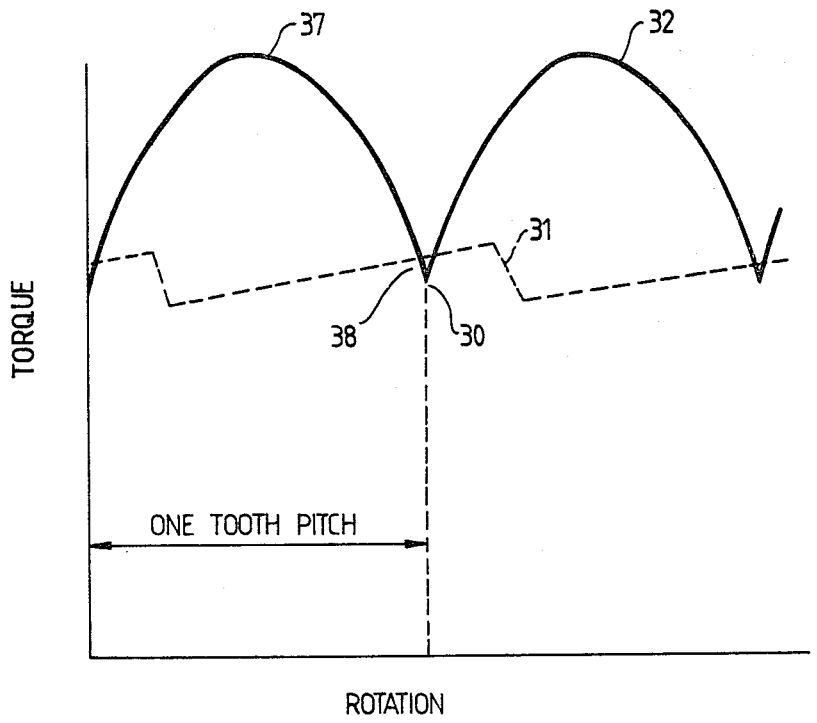
Figure 6:
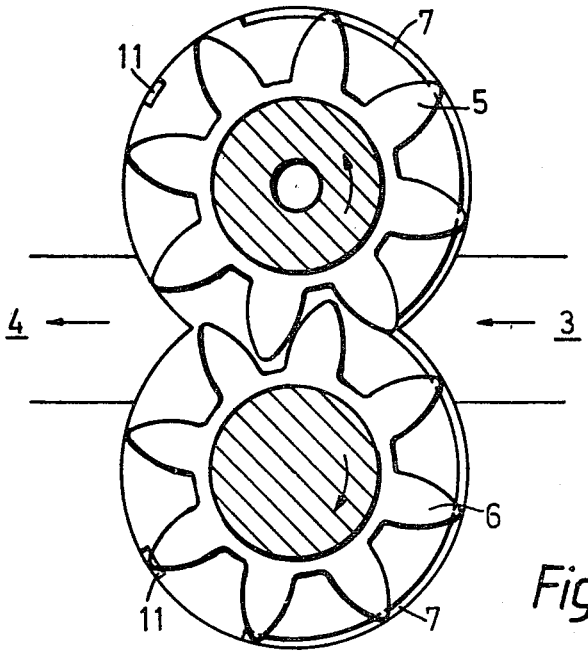
Figure 7:
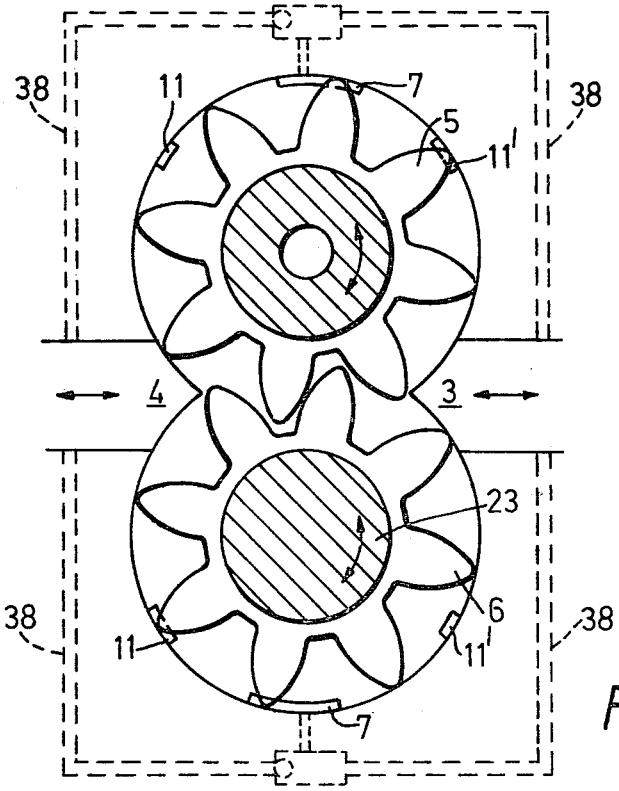

Three ways of carrying out the invention are described in detail below with reference to drawings which illustrate three specific embodiments, in which:

FIG. 1 is a cross-section of a rotary positive-displacement fluid-pressure motor of gear type in accordance with the first embodiment, FIG. 2 is a cross-section taken along the line II—II on FIG. 1, FIG. 3 is an enlarged cross-section taken along the line III—III on FIG. 1 and showing the two gears of the motor in one condition of mesh, FIG. 4 is a cross-section similar to that of FIG. 3 but with the gears in another condition of mesh, FIG. 5 is a graphical representation of the torque output characteristics of the motor shown in FIGS. 1 to 4, FIG. 6 is a cross-section similar to that of FIGS. 3 and 4, but in accordance with the second embodiment, and, FIG. 7 is a cross-section similar to that of FIGS. 3, 4 and 6, but in accordance with the third embodiment.

FIGS. 1 to 4 show a rotary positive-displacement fluid-pressure motor 1 of the gear type intended to be driven by fluid, for example hydraulic liquid, under high pressure derived from a suitable source (not shown). In its basic design the motor includes a casing 2, having an inlet port 3 and an outlet port 4, two intermeshing rotors 5, 6 of toothed form housed for rotation in the casing, and means 7 for conducting pressure-fluid derived from the port 3 as far as a predetermined position 8 in a face 9 disposed adjacent, and engaged by, a side 10 of one of said rotors.

In accordance with the invention the motor is provided with a recess 11 so disposed in the face 9 intermediate the predetermined position 8 and the outlet port 4 that, for facilitating starting of the motor when fluid under high pressure is directed into the inlet port 3, some of that fluid can gain access to the recess 11 by way of the means 7 and whichever intertooth space 12 of the rotor is so positioned as to place the means 7 and the recess 11 in communication.

As shown, the means 7 comprises a groove which opens directly to port 3 and which so extends across the face 9 to the predetermined position 8 as to be in direct communication with those intertooth spaces 12 which at any instant are passing that groove.

The face 9 is formed upon end plate means 14 suitably located in the casing. The end plate means is provided with a pressure-balancing arrangement (not shown) associated with that face 15 thereof remote from the rotors. This arrangement, of which there are many known examples, is intended to avoid inadvertent tilting of the end plate means and the onset of consequent premature wear of the sides of the rotors and of the adjacent faces of the end plate means otherwise experienced, during operation, in motors not so provided with a pressure-balancing arrangement. In order to achieve pressure-balancing the face 15 is so divided by suitable sealing means as to define areas thereof which are subjectable to low fluid pressures and areas thereof which are subjectable to high fluid pressures, the relative sizes of these areas and their disposition being so predetermined that the pressures acting thereupon in operation of the motor do so in opposition to the pressures which subsist in the working spaces of the motor and which are effective upon the face 9 of the end plate means adjacent the rotors. The pressure-balancing arrangement is intended also to urge the end plate means into adequate sealing engagement with the rotors without the generation of undue friction between them. In this embodiment the end plate means 14 is common to the two rotors 5, 6, and a further common end plate means 16 is provided, being disposed on the other side of the rotors and in engagement therewith. This further end plate means is also provided with its own pressure-balancing arrangement (not shown) associated with that face 17 thereof remote from the rotors.

Also in this embodiment a groove 7 and a recess 11 are provided in the face 9 in the manner shown adjacent the sides 10 of both of the rotors 5, 6 and likewise a groove 7 and a recess 11 are provided in the face 18 of the further end plate means 16 adjacent the other sides 19 of both of the rotors.

Each of the grooves 7 is in direct communication with the inlet port 3, in the manner shown in FIGS. 2, 3 and 4, and is produced by milling away an appropriate arcuate length of the respective peripheral edge of its end plate means. Each of the recesses 11 is likewise produced by milling away a respective portion of the same edge.

The rotors 5, 6 are each provided with shafts 20, 21; 22, 23 extending from both side thereof, these shafts being respectively supported in bushes 24, 25; 26, 27 suitably retained in the casing 2. The shaft 23 extends to the exterior of the casing as shown, thus forming the output shaft of the motor.

Both of the end plate means 14, 16 are each apertured to receive two of the shafts 21, 23; 20, 22 respectively, and each end plate means is generally of figure-of-eight shape, being housed in overlapping bores 28 and 29 provided in the casing.

In this embodiment the two recesses 11 adjacent the gear 6 are each one half a tooth pitch closer to the ends 8 of their respective grooves 7 than the two recesses 11 adjacent the gear 5, as shown in FIGS. 2, 3 and 4.

When a fluid is supplied at constant pressure to the inlet port of a gear motor, the resulting torque output varies cyclically during rotation of the gears in the manner shown graphically in FIG. 5 which plots torque against rotation. If, when it is required to start a gear motor not embodying the present invention the gears happen to be meshing at the condition which results in, or approaches, the trough indicated at 30, it may prove very difficult to start the motor and in some cases starting may be impossible regardless of the magnitude of the fluid pressure applied at the inlet port. In the case of motors having pressure-balanced end plate means, but again not embodying the present invention, this problem can be aggravated by variations in the fluid-pressure loading upon the end plate means because that loading is reacted partly mechanically by the gears and partly by the pressure of fluid between, and under, the gear teeth. Due to the fluid pressure present in the inlet port, on attempting to start, certain of the gear teeth seal at their tips against those portions of the wall of the motor casing 2 opposite to the inlet port. Thus the build-up of the desired pressure field over the face of the end plate means adjacent the gears is impaired and a high mechanical friction load occurs due to the imbalance across the end plate means. With the meshing gears, just prior to attempting motor starting, at the position of minimum cyclic torque, the motor starting torque will therefore be low, or even zero. The dotted line 31 on FIG. 5 indicates the typical sawtooth friction torque curve resulting from the loading of the end plate means. The zone of intersection of this line just above the trough 30 of the cyclic curve 32 indicates that such a poor starting torque condition occurs only over a small angle of rotation and shows that the starting torque is zero when the friction torque is greater than the hydraulic torque depicted by the curve 32.

The provision of the recesses 11 in accordance with this invention is intended to overcome such starting difficulty, these recesses ensuring that such a condition of poor starting torque over that small angle of rotation is avoided.

FIG. 3 shows the tooth 33 of the gear 5 in a position beyond the predetermined position 8 at the end of each groove 7 adjacent that gear and the tooth 34 in a position passing over that groove so that the space 12 between the teeth 33 and 34 is sealed from each recess 11 adjacent that gear. Since, however, the teeth of the gear 6 are one half a tooth pitch out of phase, in rotation, with respect to the teeth of the gear 5 and since each recess 11 adjacent the gear 6 is disposed one half a tooth pitch closer to its respective associated groove 7, then, simultaneously at the condition shown in FIG. 3, the tooth 35 of the gear 6 is in a position beyond each recess 11 adjacent that gear and the tooth 36 is in a position passing over that groove 7 so that the space 12 between the teeth 35 and 36 places each groove 7 adjacent the gear 6 in communication with its associated recess 11.

This meshing condition of the gears 5 and 6 corresponds to the peak torque condition, or substantially so, indicated at 37 in FIG. 5, and thus if the gears are in this meshing condition when fluid, for example hydraulic liquid, under pressure is directed to the inlet port, there is no difficulty in the starting-up of the motor.

If, however, when it is required to start the motor it so happens that the meshing condition of the gears 5 and 6 is one half a tooth pitch out-of-phase from the condition shown in FIG. 3, that is at the condition shown in FIG. 4, the motor is at the minimum torque condition indicated at the trough 30 of the curve 32 in FIG. 5 and but for the provision of the recesses 11 starting up of the motor would prove to be extremely difficult. In the manner shown in FIG. 4 the tooth 33 of the gear 5 and likewise the tooth 36 of the gear 6 are in registry at their tips with the respective recesses 11 while the tooth 34 (the tooth following tooth 33) of the gear 5 and likewise the tooth 37 (the tooth following tooth 36) of the gear 6 are still adjacent the respective grooves 7. Hence, the space 12 between the teeth 33 and 34 places the associated grooves 7 in communication with the respective recesses 11 adjacent the gear 5, while the space 12 between the teeth 36 and 37 places the associated grooves 7 in communication with the respective recesses 11 adjacent the gear 6.

Thus, fluid under pressure derived from the inlet port 3 is applied to the gears as far around the periphery thereof as the tips of the teeth 33 and 36, effecting pressure-loading on the gears sufficiently far around them towards the outlet port 4 as adequately to reduce frictional resistance at the tips of the teeth with the casing and also to avoid undue frictional resistance between the sides of the rotors and the faces 9, 18. In this way the undesirable condition as indicated at the zone 38 in FIG. 5 is avoided, thereby enabling the intermeshing gears then to commence their rotation with no likelihood of any delay in starting, abruptness in starting, or stalling.

Although in the embodiment above-described with reference to FIGS. 1 to 5 of the drawings the recesses 11 adjacent the gear 6 are one half a tooth pitch closer to their associated grooves 7 than those adjacent the gear 5, in the second embodiment of the invention and as shown in FIG. 6 the recesses 11 adjacent the gear 6 are spaced at the same distance from the associated grooves 7 as those adjacent the gear 5. Whilst this might have a slightly adverse effect upon motor start-up, it would still be an improvement over motors not so provided with such recesses and have the advantage from the production standpoint that "handing" of the end plate means in manufacture would be unnecessary.

In the embodiment above-described with reference to FIGS. 1 to 5 of the drawings the motor is uni-directional in its operation in that since the grooves 7 open directly from the inlet port 3, the gear 5 can only be rotatable in the anti-clockwise direction and the gear 6 in the clockwise direction as viewed in FIGS. 2, 3 and 4. However, in the third embodiment as shown in FIG. 7 where it is desirable for the motor to be operable in either direction of rotation of the output shaft 23, the grooves 7 do not so open directly from the inlet port. Instead, each of these grooves is much shorter in arcuate length and a further one of said recesses 11 is provided on that side of each such shorter groove remote from the respective first recess 11, the arcuate spacing between each shorter groove 7 and its further recess 11, being the same as the spacing between that groove and the respective first recess 11. Thus, whichever of the two ports 3, 4 of the motor is chosen to be the inlet port the improved start-up facility is afforded for the resultant direction of rotation of the motor output shaft. However, since there is no direct communication between each said shorter groove 7 and whichever port is chosen to be the high pressure inlet port, in this embodiment high pressure fluid reaches that groove 7 either by way of gear tooth tip/casing clearances established at those teeth moving away from the inlet port, or, alternatively, by way of a suitably provided passageway 38 disposed within the respective end plate means, which directly connects the inlet port to the respective shorter groove.

Further, although in the embodiment above-described with reference to FIGS. 1 to 5 of the drawings the motor includes end plate means having pressure-balancing arrangements, in alternative embodiments of the invention no such end plate means are provided and the rotors of the motor bear at their sides directly upon the casing. In this case the said grooves and the said recesses are formed in the faces of the casing adjacent the rotors.

Again, although in the embodiment above-described with reference to FIGS. 1 to 5 of the drawings each of the two end plate means is common to the two rotors, in alternative embodiments of the invention each rotor has individual end plate means one on each side thereof. In this case the end plate means may be of D-shaped cross-section, the two on each side of the rotors thus having flats which are in abutment one with the other. Further, in other embodiments the end plate means may be so formed as to provide the entire bushings for the respective shafts.

Finally, although in the embodiment above-described with reference to FIGS. 1 to 5 of the drawings the said grooves and recesses are produced by milling away edge portions of each end plate means, in cases where the end plate means are cast, for example in aluminium, the grooves may instead be formed during the casting process. Also, instead of the grooves 7, as well as the recesses 11, being of the cross-sectional shape shown in FIG. 1 they may be of any other desired shape, or simply formed by chamfering the respective edges of the end plate means.

I claim:

1. A fluid-pressure-operable gear motor including a casing, having an inlet port and an outlet port, at least two intermeshing rotors of toothed form housed for rotation in said casing, means for conducting pressure fluid derived from said inlet port as far as a predetermined position in a face disposed adjacent, and engaged by, a side of one of said rotors, and a recess, which is formed in said face, which is disposed intermediate said predetermined position and said outlet port and which is open only to the intertooth spaces of said one rotor which successively pass said recess during operation of the motor, the pitch of the rotor teeth and the distance between said recess and said predetermined position being such as to ensure that when the motor is at a predetermined minimum torque condition a tooth of said one rotor is in registry with said recess and the following tooth of said one rotor is adjacent said means so that for facilitating starting of the motor when fluid under high pressure is directed into said inlet port some of that fluid can gain access to said recess by way of said means and an intertooth space of said one rotor through which said means and said recess are in communication.

2. A motor as claimed in claim 1, wherein said means for conducting pressure fluid comprises a groove which opens directly to said inlet port and which so extends across said face to said predetermined position as to be in direct communication with those intertooth spaces which at any instant are passing said groove.

3. A motor as claimed in claim 1, wherein said face is formed upon end plate means suitably located in said casing.

4. A motor as claimed in claim 3, wherein said end plate means is common to said two intermeshing rotors.

5. A motor as claimed in claim 3, wherein a further said end plate means is provided, being disposed on the other side of the rotors and in engagement therewith.

6. A motor as claimed in claim 5, wherein respective said means for conducting pressure fluid and respective said recesses are provided in the faces of both of said end plate means and adjacent respective sides of each of said rotors.

7. A motor as claimed in claim 6, wherein said rotors are each provided with shafts extending from both sides thereof.

8. A motor as claimed in claim 7, wherein said shafts are supported in bushes suitably retained in said casing.

9. A motor as claimed in claim 7, wherein one of said shafts extends to the exterior of said casing, thus forming the output shaft of the motor.

10. A motor as claimed in claim 7, wherein the or each said end plate means is apertured to receive two of said shafts and is generally of figure-of-eight shape, being housed in overlapping bores provided in said casing.

* * * * *